US005666259A

United States Patent [19]

Cooter et al.

[11] Patent Number: 5,666,259

[45] Date of Patent: *Sep. 9, 1997

[54] STATIC ELECTRICITY DISSIPATION DEVICE FOR COMPUTERS

[76] Inventors: Kevin L. Cooter, 4491 Bent Bros. Blvd., Colorado City, Colo. 81019; Stephen R. Cooter, 42 Carlile Pl., Pueblo, Colo. 81005

[ * ] Notice: The term of this patent shall not extend beyond the expiration date of Pat. No. 5,406,443.

[21] Appl. No.: 578,384

[22] Filed: Dec. 26, 1995

Related U.S. Application Data

[60] Continuation of Ser. No. 419,802, Apr. 11, 1995, abandoned, which is a division of Ser. No. 105,373, Aug. 11, 1993, Pat. No. 5,406,443.

[51] Int. Cl.[6] ..... H05F 3/00

[52] U.S. Cl. ..... 361/212; 361/220

[58] Field of Search ..... 361/212, 220, 361/221, 223, 224, 225; 307/99; 174/55 G

[56] References Cited

U.S. PATENT DOCUMENTS

| | | | |
|---|---|---|---|
| 4,468,702 | 8/1984 | Jandrell | 361/220 |
| 4,745,518 | 5/1988 | Fang | 361/220 |
| 5,208,635 | 5/1993 | Reese et al. | 361/221 |
| 5,335,137 | 8/1994 | English et al. | 361/212 X |
| 5,406,443 | 4/1995 | Cooter et al. | 361/221 |
| 5,450,277 | 9/1995 | Wescott et al. | 361/220 |

FOREIGN PATENT DOCUMENTS

| | | | |
|---|---|---|---|
| 004016590 | 11/1991 | Germany | 361/212 |

*Primary Examiner*—Fritz Fleming
*Attorney, Agent, or Firm*—William E. Hein

[57] ABSTRACT

A static electricity dissipation system for computers includes a display/CRT antenna console that rests on top of the computer screen housing and grounds the computer screen housing by means of a carbon foam member attached to the underside of the display/CRT antenna console, a grounded metal antenna extending from the front of the display/CRT console and having a carbon fiber brush that is in physical and electrical contact with the computer screen, a grounded conductor that is connected directly to the computer CPU housing, and a strip of conductive carbon foam material that is attached to the space bar or any other primary key of the computer keyboard to continuously drain static charge away from the user. The display/CRT antenna console includes an LCD display chip to provide a visual indication each time an electrostatic charge on the user is dissipated.

4 Claims, 2 Drawing Sheets

STATIC ELECTRICITY DISSIPATION DEVICE FOR COMPUTERS

REFERENCE TO RELATED APPLICATIONS

This application is a continuation of Ser. No. 08/419,802, filed Apr. 11, 1995, now abandoned, which is a division of application Ser. No. 08/105,373 filed Aug. 11, 1993, now issued as U.S. Pat. No. 5,406,443.

BACKGROUND AND SUMMARY OF THE INVENTION

This invention relates generally to devices for dissipating static electricity and more particularly to an eletrostatic dissipation system for protecting computer equipment from harmful electrostatic discharges by simultaneously dissipating static electricity from both the user and the computer equipment itself.

Recent studies show that more than 60% of computer downtime is caused by static electricity. Consequently, one-fourth of all micro-computers are retired due to electrostatic discharge. It is has been learned that as little as 250 volts of static electricity can cause data and memory loss, resets, erroneous commands, and damage to sensitive microcircuitry. In addition, harmful ELF/VLF radiation emanating from the computer screen is an unwanted byproduct of static produced by the screen itself and produces an unhealthy work environment.

Several techniques are known in the prior art to prevent electrostatic discharges that may prove harmful to computers or other electronic equipment. U.S. Pat. No. 4,602,310 to Fenster teaches dissipating electrostatic charge under the influence of a magnetic field in a conductive foam body and then discharging the electrostatic charge to ground potential. However, since electrostatic charge cannot be obediently routed, the magnets taught in this reference serve no useful purpose.

U.S. Pat. No. 4,586,106 to Frazier teaches placing a static dissipative touch strip in a position in which it may be touched by the user before he or she touches the electronic equipment sought to be protected. However, since static electricity continuously builds as the result of such simple user movements as rolling back and forth in a chair, crossing the legs, or actuating a keyboard, the electronic equipment is likewise continuously in jeopardy. Similarly, U.S. Pat. No. 4,654,746 to Lewis, Jr. et al. teaches a static dissipator button adapted for actuation by the user of equipment whenever it is desired to dissipate any electrostatic charge. Both the "TOUCH ME FIRST STRIP" of Frazier and the button of Lewis, Jr. et al. are in effective since they do not continuously guard against electrostatic charge. It is impractical for the user to interrupt operation of a computer, for example, every few seconds in order to touch the strip of Frazier or actuate the button of Lewis, jr. et al. to periodically dissipate any electrostatic charge.

U.S. Pat. No. 4,303,960 to Sherwood et al. teaches a tactile matrix switch used with layers of conductive ink to channel electrostatic charge from the user to earth ground. The possibilities of slapback shock remain, however, since this reference teaches only a direct routing to ground.

Other known techniques for dissipating electrostatic charge are those taught in U.S. Pat. Nos. 4,482,064 and 4,481,556 to Berke et al., U.S. Pat. No. 4,146,291 to Goff et al., U.S. Pat. No. 4,040,120 to Geadah et al., U.S. Pat. No. 4,456,800 to Holland, U.S. Pat. No. 4,398,277 to Christiansen et al., and U.S. Pat. No. 2,568,068 to Harpman.

Static sprays have also been used as a popular means of preventing static electricity buildup on computer screens and other electronic equipment. Many computer users dutifully clean and spray their screens daily, believing that by doing so they are protecting their equipment from the harmful effects of what they perceive as being dirt. However, sprays only clean off the effects of static discharge after the fact. Static jolts have already left their marks on a computer screen, causing dirt particles to be anti-charged, resulting in the clinging of dirt particles to the screen. Furthermore, sprays do nothing to protect the sensitive computer microcircuit electronics from constant static electricity discharges.

It is therefore a principal object of the present invention to provide a static electricity dissipating system that effectively drains electrostatic charge from a computer screen, as well as from the computer microcircuitry and the keyboard while simultaneously dissipating ongoing static buildup from the user before it has an opportunity to be conveyed to any component of the computer system.

This and other incidental objects are accomplished in accordance with the illustrated preferred embodiment of the present invention by providing a display/CRT antenna console that is adapted for positioning on top of the computer screen housing, a grounded metal antenna extending from the front of the display/CRT console and having a carbon fiber brush that is in contact with the uppermost part of the computer screen, a grounded conductor that is connected directly to the computer CPU housing, a strip of highly conductive carbon foam material that is attached to the space bar or any other primary key of the computer keyboard to continuously drain static charge away from the user, and an LCD display chip for providing a visual indication whenever an electrostatic charge on the user is dissipated.

DETAILED DESCRIPTION OF THE PREFERRED EMBODIMENT

Figure 1:
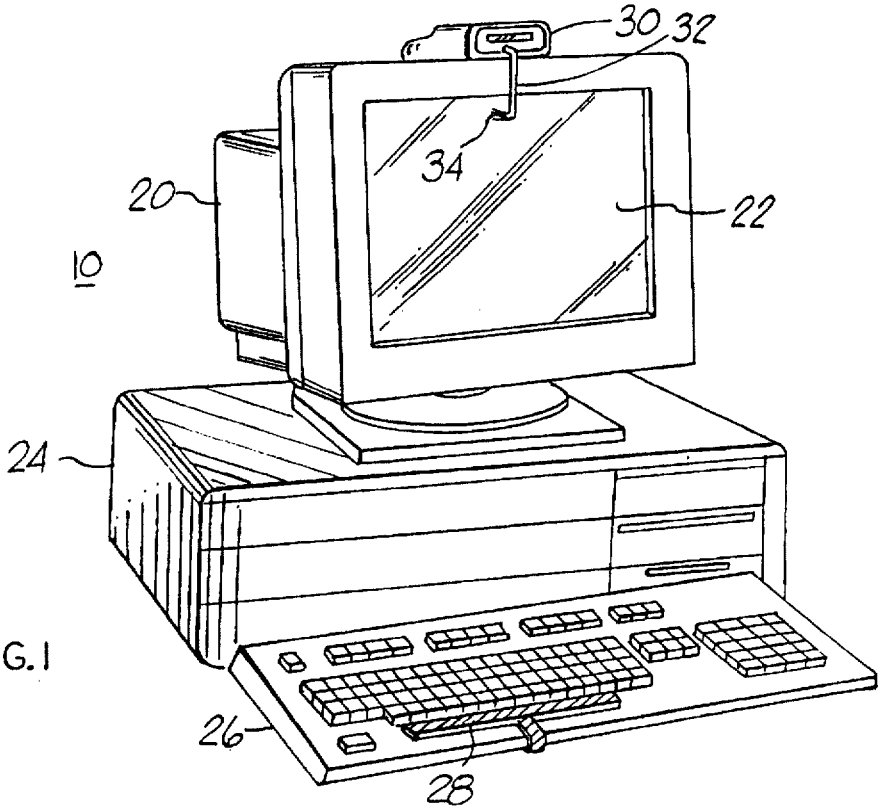
FIG. 1 is a pictorial diagram illustrating a typical computer system incorporating the static electricity dissipation system of the present invention.

Referring now to the pictorial diagram of FIG. 1, there is shown a typical computer system 10 that includes a display 20 having a CRT screen 22, a central processing unit (CPU) 24, and a manual control means, which may comprise a keyboard 26. A keyboard touch strip 28 is adhesively attached over one or more keys, such as a conventional space bar, of keyboard 26. Keyboard touch strip 28 is preferably fabricated of a highly conductive carbonized foam material of the type that is commercially available. Exemplary of such a material is conductive polyethylene of 0.032" thickness, 9# density, and less than 30,000 ohms/sq. in. resistivity. A display/CRT antenna console 30 is adapted to rest on top of display 20.

Figure 2:
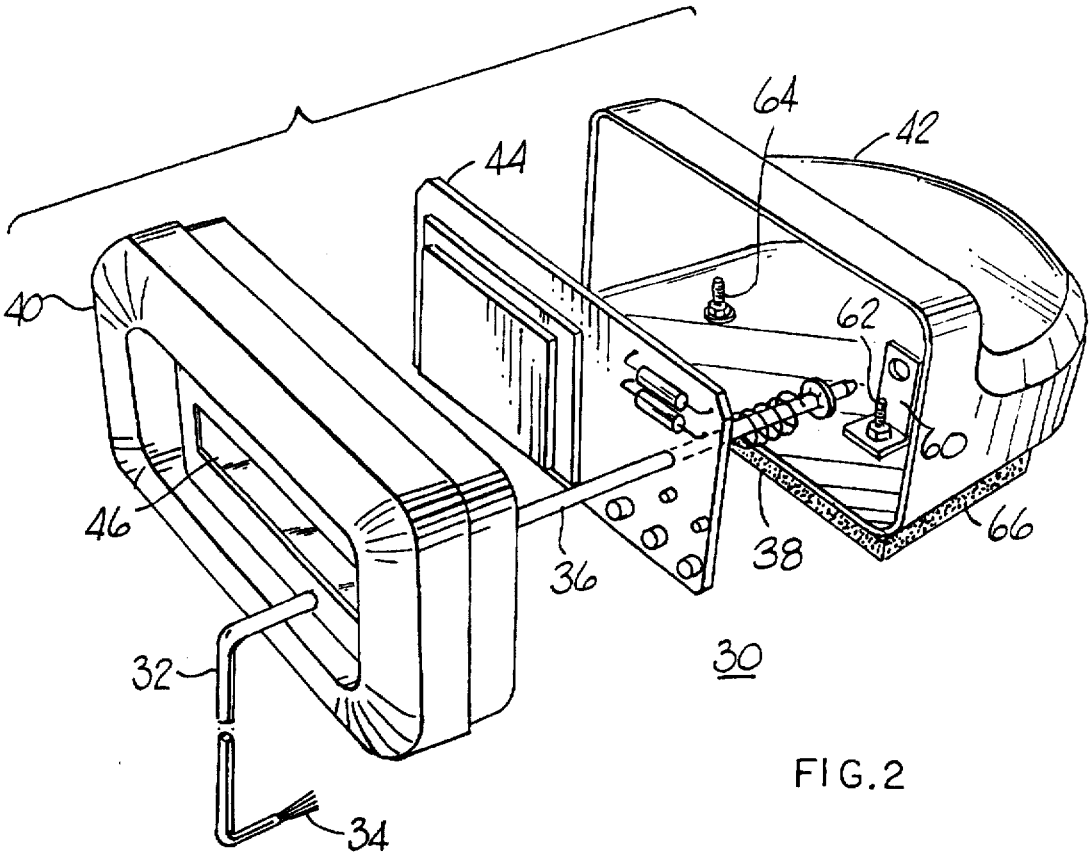
FIG. 2 is an exploded pictorial diagram of the display/CRT antenna console of the static electricity dissipation system of FIG. 1.

Referring now also to FIG. 2, display/CRT antenna console 30 includes a CRT antenna 32 that terminates at forward end in an electrically conductive carbon fiber multi filament brush 34 of a type commercially available. CRT antenna 32 is mounted in display/CRT antenna console 30 so as to pivot about a horizontal arm member 36 and to move outwardly against the force of a spring 38 so that physical contact and, hence, electrical contact, is maintained between brush 34 and CRT screen 22 when display/CRT antenna console 30 is in place on top of display 20. Display/CRT antenna console 30 includes front and rear housing members 40, 42 and a printed circuit board 44 mounted therein. A metal bracket 60 is mounted within rear housing member 42 to mechanically support the rear end of horizontal arm member 36 of CRT antenna 32. A rectangular piece of carbon foam material 66 is held in place on the bottom of rear housing member 42 by a pair of metal screws 62, 64. Screw 62 also serves to hold metal bracket 60 in place within rear housing member 42.

Figure 3:
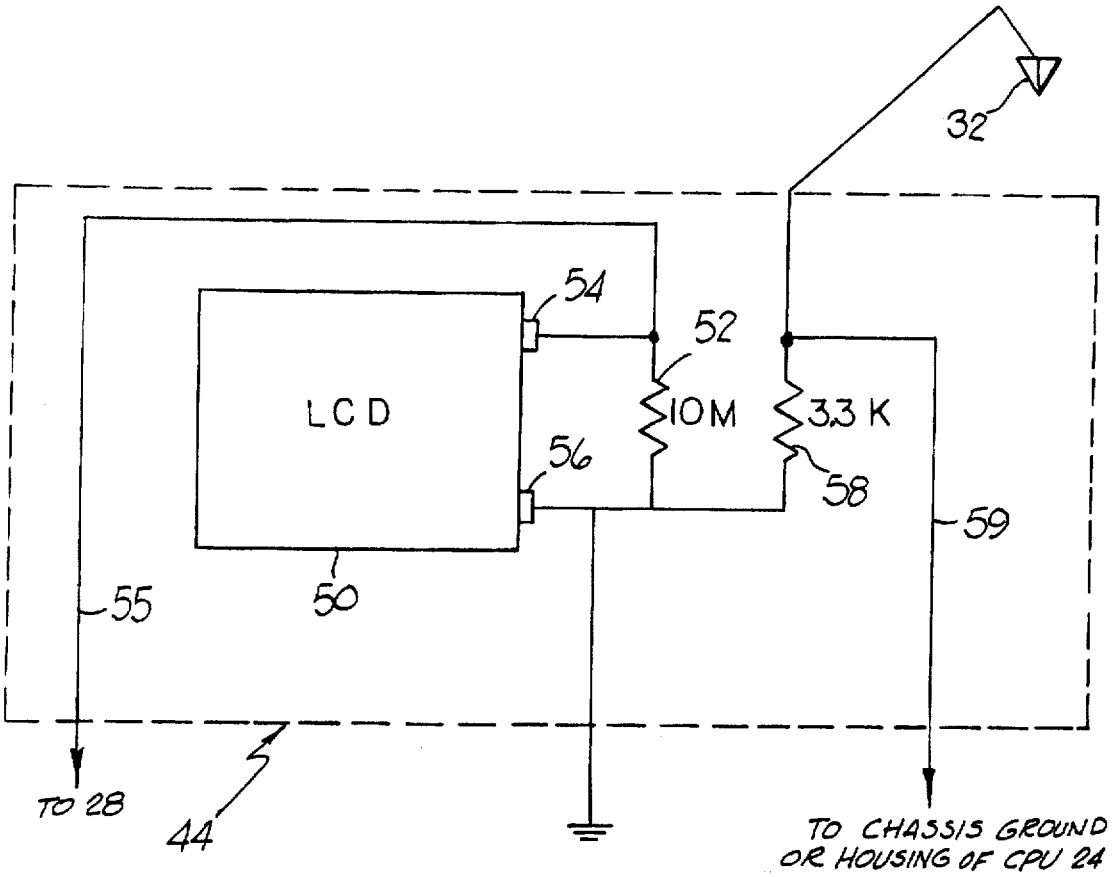
FIG. 3 is a detailed schematic diagram of the circuitry employed in the display/CRT antenna console of FIG. 2.

Referring now also to FIG. 3, there is shown a detailed circuit diagram of circuit components located on printed circuit board 44 within display/CRT antenna console 30. A conventional LCD display chip 50 is positioned on printed circuit board 44 so as to visible through a window 46 in front housing member 40 of display/CRT antenna console 30. LCD display chip 50 may be fabricated to visually display any desired alphabetic, numeric or graphic character whenever an electrostatic charge is dissipated through the system of the present invention. A resistor 52 is connected across terminals 54, 56 of LCD display chip 50. Terminal 56 is connected to an earth ground such as may typically be available at an A.C. line voltage wall outlet, and terminal 54 is connected via a line 55 to keyboard touch strip 28. A resistor 58 is connected between terminal 56 of LCD display chip 50 and CRT antenna 32. A line 59 also connects CRT antenna 32 to the chassis or housing of CPU 24. An electrical connection between carbon foam material 66 on the bottom of rear housing member 42 and the chassis or housing of CPU 24 is established through metal bracket 60 and CRT antenna 32. Carbon foam material 66 thereby serves to discharge any electrostatic charge on display 20 to ground through the housing of CPU 24.

We claim:

1. A static electricity dissipating system for connection to apparatus comprising a cathode ray tube (CRT) screen for simultaneously, continuously draining electrostatic charge from the screen, from a housing therefor, from manual control means of the apparatus, and from a user of the apparatus, the static electricity dissipating system comprising:

a display/CRT antenna console for mounting on the housing, the display/CRT antenna console comprising an electrically conductive antenna in physical and electrical contact with the screen;

LCD display means for providing a visual indication each time an electrostatic charge on a user is dissipated, the LCD display means having first and second input terminals, the second input terminal being connected to earth, the display/CRT antenna console being electrically connected to the housing;

electrically conductive means provided on the manual control means and electrically connected to the first input terminal of said LCD display means; and circuit means for electrically connecting the antenna, the display/CRT antenna console, and the housing to earth.

2. A method for simultaneously, continuously dissipating static electricity from a screen of a cathode ray tube (CRT) of an apparatus comprising the CRT, from a housing therefor, from manual control means of the apparatus, and from a user of the apparatus, the method comprising the steps of:

providing a display/CRT antenna console on the housing, the display/CRT antenna console including an electrically conductive antenna positioned to be in physical and electrical contact with the screen so as to dissipate electrostatic charge therefrom;

providing an electrically conductive path between the display/CRT antenna console and housing;

providing electrically conductive means on the manual control means for dissipating electrostatic charge from a user when the manual control means is in use;

connecting the antenna, the housing, and the console to earth; and providing LCD display means in said display/CRT antenna console for producing a visual indication each time an electrostatic charge on the user is dissipated.

3. A static electricity dissipating system for connection to a computer for simultaneously, continuously draining electrostatic charge from a computer screen, a computer screen housing, a computer CPU housing, a computer keyboard, and a user, the static electricity dissipating system comprising:

a display/CRT antenna console for mounting on the housing, the display/CRT antenna console containing LCD display means for providing a visual indication each time an electrostatic charge on the user is dissipated, the LCD display means having first and second input terminals, the second input terminal being connected to an earth ground and the display/CRT antenna console further including electrically conductive means provided on a surface thereof intended to bear against the computer screen housing;

electrically conductive means provided on a selected one or more keys of the computer keyboard and electrically connected to the first input terminal of said LCD display means; and circuit means for connecting the CRT antenna, the console, and the computer CPU housing to earth.

4. A method for simultaneously, continuously dissipating static electricity from a computer screen, a computer screen housing, a computer CPU housing, a computer keyboard, and a user, the method comprising the steps of:

providing a display/CRT antenna console on the computer screen housing, the display/CRT antenna console including an electrically conductive antenna positioned to be in physical and electrical contact with the computer screen so as to dissipate electrostatic charge from the computer screen;

providing an electrically conductive path between the display/CRT antenna console and the computer screen housing;

providing second electrically conductive means on a selected one or more keys of the computer keyboard for dissipating electrostatic charge from the user when the keyboard is in use;

connecting the antenna, the CPU housing, the display/CRT antenna console, and the screen housing to earth; and providing LCD display means in said display/CRT antenna console for producing a visual indication each time an electrostatic charge on the user is dissipated.

* * * * *